United States Patent [19]

Hansen et al.

[11] Patent Number: 4,718,209

[45] Date of Patent: Jan. 12, 1988

[54] WEDGE ANCHORAGE FOR A TENSION MEMBER IN A PRESTRESSED CONCRETE STRUCTURE

[75] Inventors: Per C. Hansen, Oslo, Norway; Gero Herrmann, Karlsfeld, Fed. Rep. of Germany

[73] Assignee: Dyckerhoff & Widmann Aktiengesellschaft, Munich, Fed. Rep. of Germany

[21] Appl. No.: 790,043

[22] Filed: Oct. 22, 1985

[30] Foreign Application Priority Data

Oct. 24, 1984 [DE] Fed. Rep. of Germany ..... 3438865

[51] Int. Cl.[4] ..... E04C 3/10

[52] U.S. Cl. ..... 52/223 L; 52/230

[58] Field of Search ..... 52/230, 223 L; 24/122.6, 136 R

[56] References Cited

U.S. PATENT DOCUMENTS

| | | | |
|---|---|---|---|
| 3,820,832 | 6/1974 | Brandestini et al. | 52/230 X |
| 3,965,543 | 6/1976 | Connors | 24/136 R |
| 4,307,550 | 12/1981 | Behar | 24/136 R |
| 4,363,462 | 12/1982 | Wlodkowski et al. | 52/230 X |
| 4,442,646 | 4/1984 | Prevedini | 52/230 |

FOREIGN PATENT DOCUMENTS

| | | | |
|---|---|---|---|
| 166560 | 8/1950 | Austria | 52/223 L |
| 2506395 | 1/1978 | Fed. Rep. of Germany | 52/230 |
| GM8002044 | 4/1980 | Fed. Rep. of Germany | 52/230 |
| 193899 | 1/1965 | Sweden | 52/230 |
| 482080 | 1/1970 | Switzerland | 52/230 |
| 1093323 | 11/1967 | United Kingdom | 52/230 |
| 1216923 | 12/1970 | United Kingdom | 52/223 L |

*Primary Examiner*—Carl D. Friedman

*Attorney, Agent, or Firm*—Toren, McGeady & Associates

[57] ABSTRACT

A wedge anchorage for an axially elongated tension member, encased in and arranged to prestress a concrete structure, includes an anchor member with a conically widening surface where a wedge seats for securing the tension member in the tensioned state with a cap arranged to fit in locked engagement with the end of the anchor member through which the tension member extends out of the concrete structure. The cap has a cover wall extending transversely of the axial direction and spaced from the anchor member. An opening is provided in the cover wall through which the tension member extends out of the concrete structure. A spring or other biasing member is located within the cap for limiting axial displacement of the wedge when the tension member is stressed in tension. This arrangement avoids the formation of a recess in the surface of the concrete structure from which the tension member extends and the need for a filler member for sealing off the recess when the prestressing operation is completed.

15 Claims, 5 Drawing Figures

FIG. 2
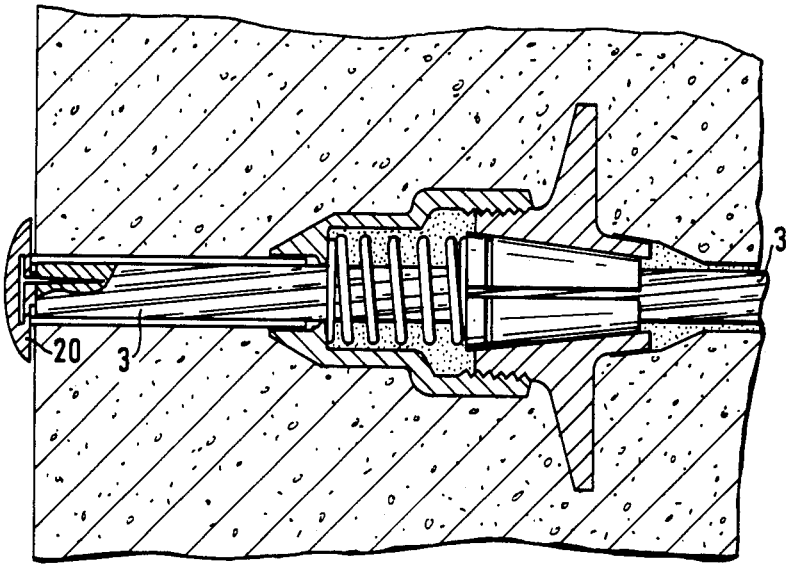
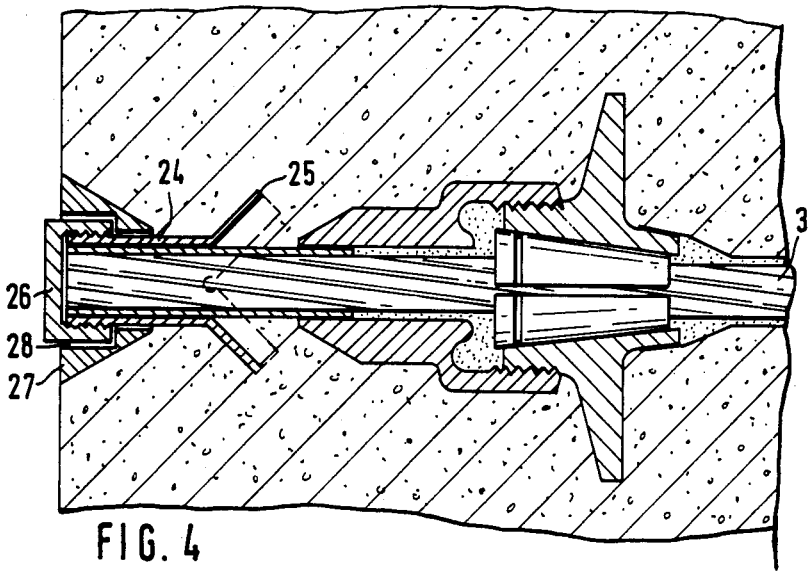
FIG. 4

WEDGE ANCHORAGE FOR A TENSION MEMBER IN A PRESTRESSED CONCRETE STRUCTURE

BACKGROUND OF THE INVENTION

The present invention is directed to a wedge anchorage for the end of a single tension member within a prestressed concrete structure to which tensioning means are attached. The tension member is completely enclosed within and spaced inwardly from the surface of the concrete structure. The anchorage is provided by an anchor member and a wedge seated within the anchor member. The anchor member has an axially extending passage for the tension member with the passage having a conically widening surface forming a seat for the correspondingly shaped wedge.

Such a wedge anchorage is known in the Swiss patent No. 482 080. In this patent publication the tension members have two anchorages where the tension forces are transferred to the concrete structure with the members forming the anchorages embedded in the concrete structure. One anchorage is designed as a so-called fixed anchorage and is completely encased in the concrete structure, the other anchorage at the end where the tension forces are applied must remain accessible until after the tensioning is carried out, so that a tensioning stress or prestressing jack can connected to the end of the tension member.

To apply tension to the tension member a recess must be provided in the concrete structure for the prestressing equipment. After the prestressing is effected, the recess must be closed off to prevent corrosion. The closure for the recess is mainly provided by a cement mortar plug so that the anchorage located within the recess is completely enclosed within the concrete structure. Disregarding the fact that the recess must be formed and subsequently sealed off, a dependable corrosion protection can be obtained only with considerable difficulty, since there is always the possibility of shrinkage of the cement mortar plug causing it to separate from the recess whereby moisture can enter and penetrate to the tension member and its anchorage. It is known in fixed anchorages to provide the anchor member at the point where the tension member passes out of the anchorage with a cap. A compression spring is located within the cap and surrounds the end of the tension member extending through the wedge and affords a frictional locking connection between the cover of the cap and the end face of the wedge for securing the wedge in position, note Swiss patent No. 482 080. It is also known to provide projecting means inside the cap arranged so that they extend into connection with the wedge and fix the wedge in position when the cap is threaded on to the anchor member, note German Utility Model No. 80 02 044.

Another arrangement is disclosed in German Offenlegungsshrift No. 25 06 395 where a plurality of wedge connections are provided in a common anchor member. There is no special noncorrosive covering for the anchorage and the tension member illustrated.

SUMMARY OF THE INVENTION

Therefore, the primary object of the present invention is to provide a wedge anchorage in which the formation of a recess containing the anchorage and a subsequent plug seal for the recess is avoided.

In accordance with the present invention, a cap is positioned on the end of the anchor member through which the tension member extends out of the concrete structure with the cap locked on the anchor member. The cap has at least one opening through which the tension member can extend out of the concrete structure, that is, between the anchorage and the surface of the concrete structure so that the tension member is not tensioned in this region. In this region the tension member is guided so that it is axially displaceable. Means are provided inside the cap for limiting the movement of the wedge in the axial direction of the tension member while the member is being prestressed and to assure a safe seating of the wedge within the anchor member at the completion of the tensioning or prestressing operation.

Apart from the comparable concept for enclosing the fixed anchorage, that is, the anchorage at the opposite end of the tension member from where the prestressing action is effected, to provide the anchor member with a cap on the end where the prestressing takes place with the tension member extending through the anchor member and guided in an axially displaceable manner until it exits from the concrete structure, in order to be able to stress the tension member in tension, an essential feature of the invention involves assuring that the wedge, which during tension is pulled out of the conical seat in the anchor member, is effectively returned into the conical seat after the stressing procedure is completed for anchoring the prestressing force in a shrink-free manner. In accordance with the present invention means are provided within the cap for limiting the axial movement of the wedge tension member and assures an effective seating of the wedge in the anchor member when the prestressing operation is completed. In one embodiment the means are provided by a compression spring with the wedge bearing against the spring during the tensioning operation so that axial movement of the wedge is limited. Another embodiment involves the provision of a stop for limiting the axial movement of the wedge within the cap with the stop spaced a distance from the conical seat for the wedge so that the wedge does not lose its frictional contact with the tension member and is guided effectively back into the conical seat when the prestressing force acting on the tension member is released.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 2 is a view similar to FIG. 1, however, showing the tension member and anchorage in the final tensioned state;

FIG. 4 is a view similar to FIG. 2 displaying another embodiment of a closure for the exit opening in the concrete structure for the tension member.

DETAILED DESCRIPTION OF THE INVENTION

Figure 1:
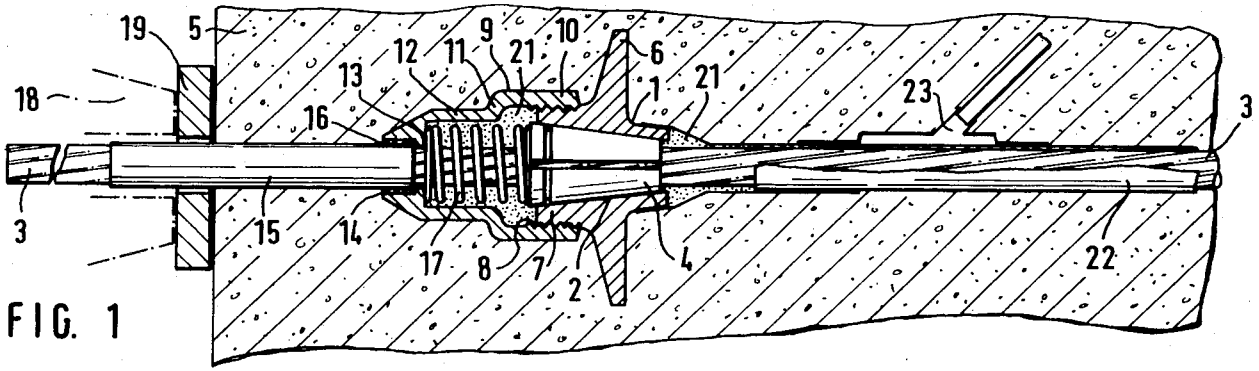
FIG. 1 is an axially extending sectional view through the anchorage of a tension member while tension is being applied.
Figure 3:
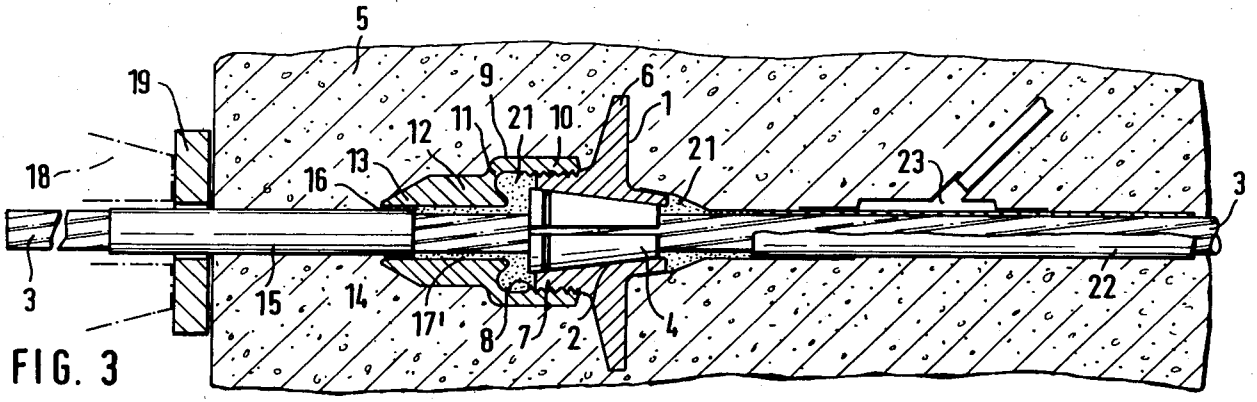
FIG. 3 is a view similar to FIG. 1 illustrating another embodiment of the invention while tension is being applied.

The wedge anchorages shown in FIGS. 1 and 3 are located within a concrete structure 5 with the outside surface of the concrete structure illustrated at the left-hand side of each figure. The wedge anchorages each include an anchor member 1 having a first end facing inwardly into the concrete structure 5 and a second end facing the outside surface of the concrete structure. An axially extending central passage 2 extends through the anchor member 1 from the first end to the second end. A tension member in the form of a steel wire strand 3 extends through the structural component 5 and through the passage 2 within the anchor member 1 and then out of the concrete structure. The passage 2 in the anchor member widens conically from the first end to the second end forms an axially extending seat for a multipart annular wedge 4. The anchor member 1 includes an outwardly projecting circular annular plate 6 extending transversely of the axial direction of the passageway 2 and forming a stop or abutment for the tension member 3 within the concrete structure 5.

Between the plate 6 and the second end of the anchor member 1 there is a cylindrically shaped extension 7 which forms the second end of the anchor member. An external thread 8 is formed on the outside surface of the extension 7. Cap 9 is screwed on to the external thread 8 by an appropriate female thread in an axially extending portion 10 of the cap which has a larger diameter than the extension 7. The arrangement of the threads can be reversed so that a female thread is provided in the anchor member 1 and an external thread is located on the cap 9. The cap 9 has an axially extending end section 12, smaller in diameter than the section 10 with a transition section 11 joining the section 10 to the end section 12. At its end closer to the outside surface of the concrete structure, the section 12 projects inwardly forming a cover 13. The outside surface of the end section 12 can be hexagonally shaped so that a conventional wrench can be used for screwing the cap on to the extension 7 of the anchor member 1.

An opening 14 is provided in the cover 13 so that the tension member or strand 3 can extend out of the cap. Strand 3 is axially displaceable in the region between the cap 9 and the outside surface of the concrete structure 5 and is laterally enclosed within a coating, such as paint, or a plastics material sheath 15. Within the opening 14 in the cap 9, the plastics sheath 15 is secured by means of a seal 16.

A compression spring 17 extending in the axial direction of the tension member 3 is located within the cap and abuts at one end against the end of the wedge 4 at the second end of the anchor member and at the other end against the inside surface of the cover 13 at the end of the cap spaced outwardly from the anchor member. Accordingly, the wedge parts making up the wedge 4 are secured by a spring washer inserted into an annular groove in the outside surfaces of the parts. The wedge 4 is pressed by the spring 17 into contact with the conically shaped seat formed in the passage 2.

The tension member including the anchorages can be placed prior to the installation of the formwork or before the concrete is poured into the formwork. Due to the present invention, no recess is required for the prestressing jack used in tensioning the tension member, only a small opening through the formwork is required so that the tension member or strand 3 extends to the outside of the concrete structure.

In a conventional manner, a prestressing jack is positioned for stressing the tension member after the concrete has set and the tensioning head 18 for the jack is shown in dotted lines in FIG. 1. The prestressing jack bears against a plate 19 and the effective surface of the plate must be adapted to the compression strength of the concrete forming the structure. By securing the prestressing jack to the tension member, the tension member is pulled out of the concrete structure 5 and is axially displaced outwardly through the sheathing 15 in the region between the cap 9 and the adjacent surface of the concrete structure against which the jack operates. This axially extending part of the strand or tension member is not prestressed after the tensioning procedure is completed. While the tension member 3 is being stretched, the wedge 4 moves somewhat against the biasing action of the compression spring 17 and when the prestressing force is released the spring biases the wedge back into bearing contact with the conically shaped seat of the anchor member 1.

To protect the anchorage against corrosion after the tension member has been cut flush with the surface of the concrete structure 5, note FIG. 2, a sealing cap 20 formed of a rubber-coated spring steel can be placed on the cut end of the tension member so that it grips in between the individual wires of the tension member strand by means of a wedge-shaped extension and is secured by spreading the wires apart.

To assure corrosion protection in the region of the anchorage itself, the space within the cap 9 and the space in the transition from the anchor member 1 to the enclosure about the tension member can be filled with a permanently plastic corrosion resistant mass 21.

The portion of the tension member between the anchorage shown in the drawing and the other anchorage located at the opposite end of the tension member can be designed in a random manner. The tension member 3 in this region can be enclosed in a plastics material sheathing, such as a PE-sheath, providing corrosion protection. It is also possible to enclose the tension member between the opposite anchorages in a known manner within a sheathing tube and to inject cement mortar or grout into the tube through an injection line 23.

If it is necessary, not only to protect the end of the tension member extending out of the concrete structure from corrosion, but also to prevent the end from being displaced out of the concrete structure if there is a fracture in the tension member or strand 3, such protection can be afforded by the arrangement depicted in FIG. 4. In FIG. 4, a sleeve 24 is placed around the end of the tension member 3 extending inwardly from the outside surface of the concrete structure 5 with the inner end of the sleeve being provided with outwardly spread parts 25. A cap 26 is placed over the end of the sleeve at the outside surface of the concrete structure. The cap can be provided in positively locked engagement with the sleeve. As illustrated, an annular groove is formed in the outside surface of the concrete structure surrounding the sleeve in a pot-shaped manner with the cap 26 having a female thread in threaded engagement with a male thread on the end of the sleeve 24. The sleeve 24 and the cap 26 are dimensioned so that they are able to withstand the forces developed upon a failure of the strand or tension member 3.

In FIGS. 3 and 4 another embodiment similar to FIGS. 1 and 2 discloses how the wedge 4 can be prevented from moving out of the anchor member during the prestressing procedure by providing a stop within the cap in position to block movement of the wedge toward the outside surface of the concrete structure.

In this embodiment, a cap 9 is threaded on to the cylindrical extension 7 of the anchor member with an appropriate female thread in the cap corresponding to the male thread on the extension of the anchor member. The cap has a larger diameter section 10 extending around the second end of the anchor member 1 with an inwardly extending transition section 11 connecting it to an end section 12 of smaller outside diameter as compared to the section 10. The portion of the end section 12 closer to the outside surface of the concrete structure 5 is formed with an end wall or cover 13. The interior of the end section 12 forms a passage 17' through which the tension member 3 extends. The end of the passage 17' remote from the anchor member 1 forms an exit opening through which the tension member extends and this opening is closed against the plastics material sheath 15 on the tension member 3 by a seal 16.

Within the cap 9 at the end of the section 12 facing toward the anchor member 1, and extending annularly about the passage 17' is an annular bead or protuberance which can also be formed of individual parts. The axial dimension of the bead corresponding to the axial direction of the tension member 3 is selected so that the wedge, though displaced out of the conically shaped seat within the anchor member when the member is tensioned, can not be displaced from the seat to the extent that it loses the frictional lock with the tension member or strand 3, the bead or stop surface permits the axial displacement of the wedge for only so far so that when the tensioning force is removed, the tension member is safely gripped by the wedge and returned into frictional contact with the seat.

Figure 5:
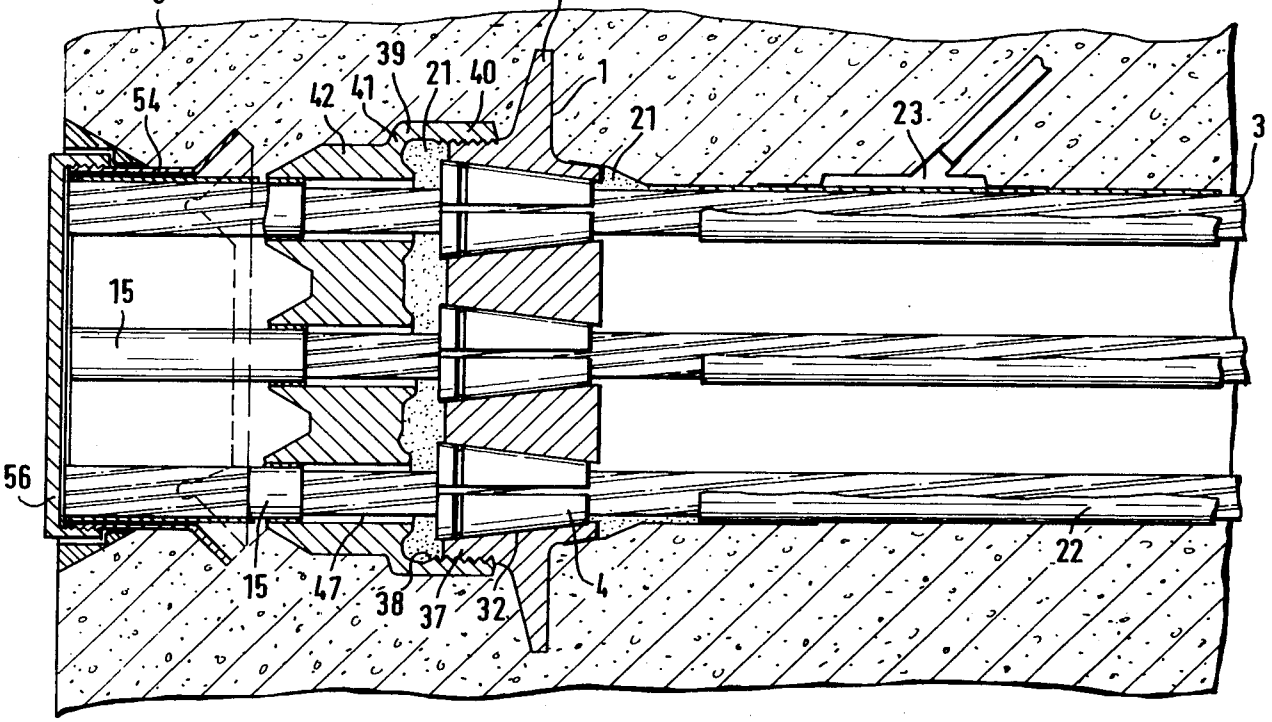
FIG. 5 is still another embodiment showing a seal for the exit opening of a plurality of tension members.

In FIG. 5 another embodiment is illustrated where the anchor member 1 has an annular anchor plate 36 with a plurality of passages extending through the anchor plate for receiving a plurality of tension members 3.

A cap 39 is provided for the second end of the anchor member 1 and has a number of passages 47 corresponding to the number of openings or passages through the anchor member. The remainder of the embodiment set forth in FIG. 5 corresponds essentially to the arrangement shown in FIG. 4. The dimensions of the sleeve 54 and of the sealing cap 56 which is threaded on to the sleeve, are adapted to the size of the overall arrangement.

While specific embodiments of the invention have been shown and described in detail to illustrate the application of the inventive principles, it will be understood that the invention may be embodied otherwise without departing from such principles.

We claim:

1. Wedge anchorage for applying tension force to one end of a tension member in a prestressed concrete structure where the tension member comprises at least one axially extending steel wire strand or the like arranged to be completely encased for the axial length thereof in the concrete structure and spaced inwardly along the length thereof from the surface thereof, said anchorage comprises an anchor member and an annular wedge with an annular inner surface for securing the tension member in the anchor member and an annular outer surface, said anchor member having an axially extending passage therethrough arranged to receive the tension member and with the tension member extending through and out of said passage, said anchor member having a first end and a second end spaced apart in the axial direction of said passage with said passage extending between the first and second ends, the surface of said passage widens conically from the first end toward the second end and forms a seating surface for the annular outer surface of said wedge, wherein the improvement comprises a cap extending in the axial direction of said passage and having a first end and a second end spaced apart in the axial direction of said passage and the first end of said cap being in locked engagement with said anchor member adjacent the second end of said anchor member, said anchor member and cap are completely encased within the concrete structure with the second end of said cap spaced inwardly from the surface of the concrete structure, said cap having a closure wall at the second end thereof extending transversely of the axial direction of said passage with an opening extending in the axial direction of said passage from the first end to the second end of said cap and through said closure wall so that the tension member can extend through and axially outwardly from said cap within the concrete structure, said tension member arranged to be tensioned between said anchor member and another anchor member spaced axially from the first end of said anchor member in the opposite direction from the second end thereof, said tension member having an axially extending part extending out of the opening through said cap and said closure wall from the second end away from the first end and being in the untensioned state after the tension member is secured in the tensioned state in said anchor member, means for guiding the axially extending part of the tension member in the untensioned state from said cap out of the concrete structure, so that it is axially displaceable relative to the concrete structure to a location where it extends from the concrete structure, and means located within said cap and in axial alignment with said wedge for limiting axial movement of said wedge within said cap in the direction from the first end toward the second end of said cap and for retaining at least an axially extending part of said wedge within said passage in said anchor member providing a secure seating of said wedge in said anchor member after completion of the tension operation so that the outer surface of said wedge remains in contact with the conical surface of said passage after tension force is applied to said tension member.

2. Wedge anchorage, as set forth in claim 1, wherein said means for limiting axial movement of said wedge comprises at least one compression spring extending in the axial direction of said tension member and located within said cap and disposed at one end in abutment with the closure wall within said cap and at the other end in contact with the end of said wedge located adjacent the second end of said anchor member.

3. Wedge anchorage, as set forth in claim 1, wherein said means for limiting axial movement of said wedge comprises at least one shoulder formed on the inside surface of said cap projecting from said closure wall toward and spaced from said anchor member and extending around at least a portion of the passage through said cap with said shoulder arranged to form a stop for the adjacent end of said wedge so that said wedge is returned to frictional engagement with said anchor member following the application of tension force.

4. Wedge anchorage, as set forth in claim 3, wherein said cap has a first axially extending section extending from the first end thereof and a second axially extending section extending from the first axially extending section through said closure wall thereof with the inside surface of said second axial extending section stepped inwardly from the inside surface of said first axially extending section and forming a surface facing toward the second end of said anchor member, and said protruding shoulder formed on and extending axially from said surface toward said anchor member.

5. Wedge anchorage, as set forth in claim 1, wherein said cap has an axially extending threaded section at the first end thereof and said anchor member has an axially extending threaded section on the second end thereof with said threaded sections arranged to be threaded one into the other for securing said cap on said anchor member.

6. Wedge anchorage, as set forth in claim 5, wherein said cap is a deep drawn part.

7. Wedge anchorage, as set forth in claim 1, wherein said tension member having an end located at the outside surface of the concrete structure after the tensioning operation has been completed, and a sealing cap arranged to be placed over the end of said tension member and to be secured to the concrete structure.

8. Wedge anchorage, as set forth in claim 7, wherein said sealing cap includes an axially extending sleeve extending around the end of said tension member between said cap secured to said anchor member and the outside surface of the concrete structure and a cap member secured to said sleeve at the end thereof located at the outer surface of said concrete structure.

9. Wedge anchorage, as set forth in claim 8, wherein said sleeve has outwardly projecting parts at the end thereof spaced inwardly from the outside surface of the concrete structure for anchoring said sleeve in the concrete structure.

10. Wedge anchorage, as set forth in claim 1, wherein a plurality of tension members extend through the concrete structure, said anchoring member having a passage therethrough for each said tension member, said cap having a corresponding number of openings therethrough so that the tension members extend through both said anchor member and said cap, and a common sealing cap for the ends of the tension members at the outside surface of said concrete structure.

11. In a prestressed concrete structure having outside surfaces, a wedge anchorage for applying tension force to one end of a tension member extending through said prestressed concrete structure, said tension member comprises at least one axially extending steel wire strand or the like completely encased for the axial length thereof in the concrete structure and spaced inwardly along the length thereof from the outside surface of the concrete structure, said anchorage comprises an anchor member and an annular wedge located within said concrete structure spaced inwardly from the outside surface thereof, said annular wedge having an annular inner surface for securing the tension member in the anchor member and an annular outer surface, said anchor member having an axially extending passage therethrough arranged to receive the tension member and with the tension member extending through and out of said passage, said anchor member having a first end and a second end spaced apart in the axial direction of said passage with said passage extending between the first and second ends, the surface of said passage widens conically from the first end to the second end and forms a seating surface for the annular outer surface of said wedge, wherein the improvement comprises a cap extending in the axial direction of said passage having a first end and a second end spaced apart in the axial direction of said passage and the first end of said cap being in locked engagement with said anchor member adjacent to said second end of said anchor member, said anchor member and cap are completely encased within the concrete structure with the second end of said cap spaced inwardly from the outside surface of the concrete structure, said cap having a closure wall at the second end thereof extending transversely of the axial direction of said passage with an opening extending in the axial direction of said passage from the first end to the second end of said cap and through said closure wall so that the tension member can extend through and axially outwardly from said cap within the concrete structure, said tension member arranged to be tensioned between said anchor member and another anchor member spaced axially from the first end of said anchor member in the opposite direction from the second end thereof, said tension member having an axially extending part extending out of the opening through said cap and said closure wall from the second end away from the first end and being in the untensioned state after the tension member is secured in the tensioned state in said anchor member, said axially extending part of said tension member being located within said concrete structure, means for guiding the axially extending part of said tension member in the untensioned state from said cap to the outside of said concrete structure, so that it is axially displaceably relative to the concrete structure to the outside surface of said concrete structure, and means located within said cap and in axially alignment with said wedge for limiting axial movement of said wedge within said cap in the direction from the first end toward the second end of said cap and for retaining at least an axially extending part of said wedge within said passage in said anchor member and for providing a secure seating of said wedge in said anchor member after completion of the tension operation so that the outer surface of said wedge remains in contact with the conical surface of said passage after tension force is applied to said tension member.

12. Wedge anchorage, as set forth in claim 11, wherein said means for limiting axial movement of said wedge comprises at least one compression spring extending in the axial direction of said tension member and located within said cap and disposed at one end in abutment with the closure wall within said cap and at the other end in contact with the end of said wedge located adjacent the second end of said anchor member.

13. Wedge anchorage, as set forth in claim 11, wherein said means for limiting axial movement of said wedge comprises at least one shoulder formed on the inside surface of said cap projecting from said closure wall toward and spaced from said anchor member and extending around at least a portion of the passage through said cap with said shoulder arranged to form a stop for the adjacent end of said wedge so that said wedge is returned to frictional engagement with said anchor member following the application of tension force.

14. Wedge anchorage, as set forth in claim 13, wherein said cap has a first axially extending section extending from the first end thereof and a second axially extending section extending from the first axially extending section through said closure wall to the second end thereof with the inside surface of said second axial extending section stepped inwardly from the inside surface of said first axially extending section and forming a surface facing toward the second end of said anchor member, and said protruding shoulder formed on and extending axially from said surface toward said anchor member.

15. Wedge anchorage, as set forth in claim 11, wherein said cap has an axially extending threaded section at the first end thereof and said anchor member has an axially extending threaded section on the second end thereof with said threaded sections arranged to be threaded one into the other for securing said cap on said anchor member.

* * * * *